United States Patent [19]

Risacher

[11] 4,354,170

[45] Oct. 12, 1982

[54] THERMOSTAT WITH POSITIVE OFF ELEMENT

[75] Inventor: Gerard H. Risacher, Mansfield, Ohio

[73] Assignee: Therm-O-Disc, Incorporated, Mansfield, Ohio

[21] Appl. No.: 135,897

[22] Filed: Mar. 31, 1980

[51] Int. Cl.[3] ..... H01H 37/52

[52] U.S. Cl. ..... 337/334; 337/360

[58] Field of Search ..... 337/334, 335, 337, 338, 337/349, 360, 361

[56] References Cited

U.S. PATENT DOCUMENTS 3,189,713 6/1965 Randolph ..... 337/338

3,223,807 12/1965 Grahl ..... 337/361 X

*Primary Examiner*—George Harris

*Attorney, Agent, or Firm*—Pearne, Gordon, Sessions, McCoy & Granger

[57] ABSTRACT

A probe thermostat is disclosed having a positive-off element included in the switch portion of the thermostat which prevents the switch from being closed when the variable control means of the thermostat is set to its extreme or "off" position. The positive-off element assures that the switch will be open even if a mulfunction occurs in the thermostat which would otherwise result in closing of the switch and undesirable current flow to the heating element. The illustrated form of positive-off element comprises an insulative threaded fastener attached to a portion of the base of the thermostat which engages one of the contact arms to hold it away from the other contact arm when the variable control means is set to its extreme "off" position.

12 Claims, 2 Drawing Figures

THERMOSTAT WITH POSITIVE OFF ELEMENT

BACKGROUND OF THE INVENTION

This invention relates generally to thermostat controls and, more particularly, to a novel and improved probe-type thermostat with a positive-off.

PRIOR ART

Probe-type thermostats are well known, and are usually used to position the temperature sensing means at a specific location spaced from the switch. For example, the probe thermostat of the illustrated embodiment, but without a positive-off, has been manufactured by the assignee of the present invention for use in the automatic control of fry pans or the like. Such thermostats are arranged so that they may be easily removed from the pan so that the pan can be washed without danger of water damage to the thermostat and then reinstalled when the pan is again used. The probe structure, when installed, provides accurate temperature sensing adjacent to the center of the pan while the switch structure and temperature adjustment mechanism is located to one side of the pan. Such probe thermostats, which have been manufactured by the assignee of the present invention and which constitute prior art, did not provide a positive-off but were turned off only by adjusting the temperature control to an operating temperature below the expected environmental temperature. Such off systems, which are not positive, are not as safe or desirable as systems employing a positive-off.

SUMMARY OF THE INVENTION

The present invention provides a novel and improved positive-off structure for thermostatic controls, particularly of the probe-type used in fry pans or the like. In accordance with this invention, the positive-off function is added to an existing control by the simple expedient of adding a stop surface positioned to engage one of the switch contact arms and limit its movement in a direction toward the other arm to a predetermined position. Such stop surface cooperates with the normal temperature adjusting element of the thermostat to positively prevent switch closure when such temperature adjusting element is adjusted to its off-position.

In the illustrated preferred embodiment, the positive-off function is added to the thermostat by a single screw formed of non-conductive material which is threaded into the thermostat body and is positioned so that the head is engageable by one of the switch contact arms to limit its movement toward the other switch contact arm beyond a predetermined position. This simple screw structure cooperates with the temperature adjusting screw when the latter is adjusted to its off position to positively maintain the switch contacts open. Compensation for dimensional variation between controls resulting from manufacturing tolerances is provided by threading the screw in or out of the body, as the case may be, to its proper position during the manufacture of the control. After adjustment is completed, the screw is locked in its adjusted position by a sealing compound.

With the present invention, a positive-off function is added to an existing probe-type thermostat of the type used in fry pans or the like with an exceedingly simple structure which does not complicate manufacture or significantly add to the manufacturing costs.

DETAILED DESCRIPTION OF THE DRAWINGS

Figure 1:
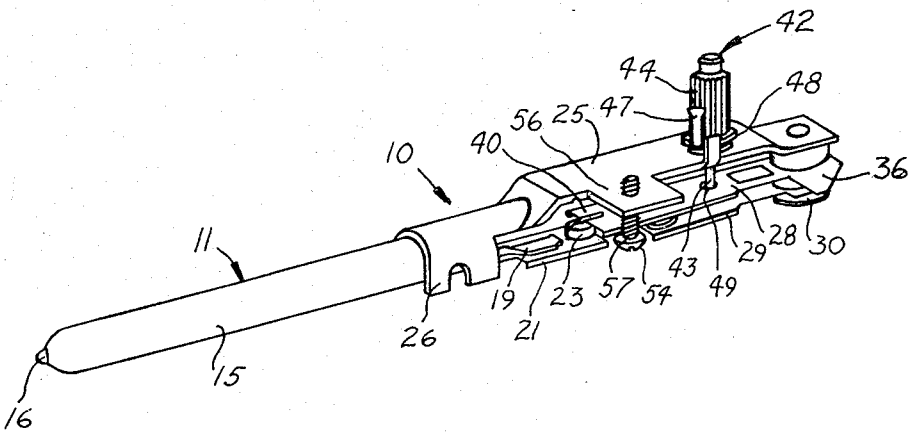
FIG. 1 is a perspective view of the thermostat of the present invention.

Referring more particularly to the drawings, there is shown a probe thermostat 10 which comprises a thermal sensing portion 11 and a switch portion 12.

The thermal sensing portion 11 may be of any known type, and is preferably a differential expansion assembly as shown in the drawings. The differential expansion assembly comprises a rod 14 disposed within a tubular body 15. One end of the tubular body 15 is closed to form a probe head 16 which is adapted to be inserted into the area in which the thermal condition is to be sensed. The rod 14 is attached at one end 17 to the probe head 16 of the tubular body, and a hinged portion 18 is formed in the rod adjacent to the end 17 so that the reamainder of the rod 14 is capable of pivoting about the end 17. The other end 19 of the rod 14 extends from the open end 20 of the tubular body 15. A projecting member 21 extends from the rod end 19 and is attached by means of a short connecting member 22 to a portion of the open end 20 of the tubular body 15. At the end of the projecting member 21 is an insulative bumper 23 which is used to engage the switch portion 12 of the thermostat.

Figure 2:
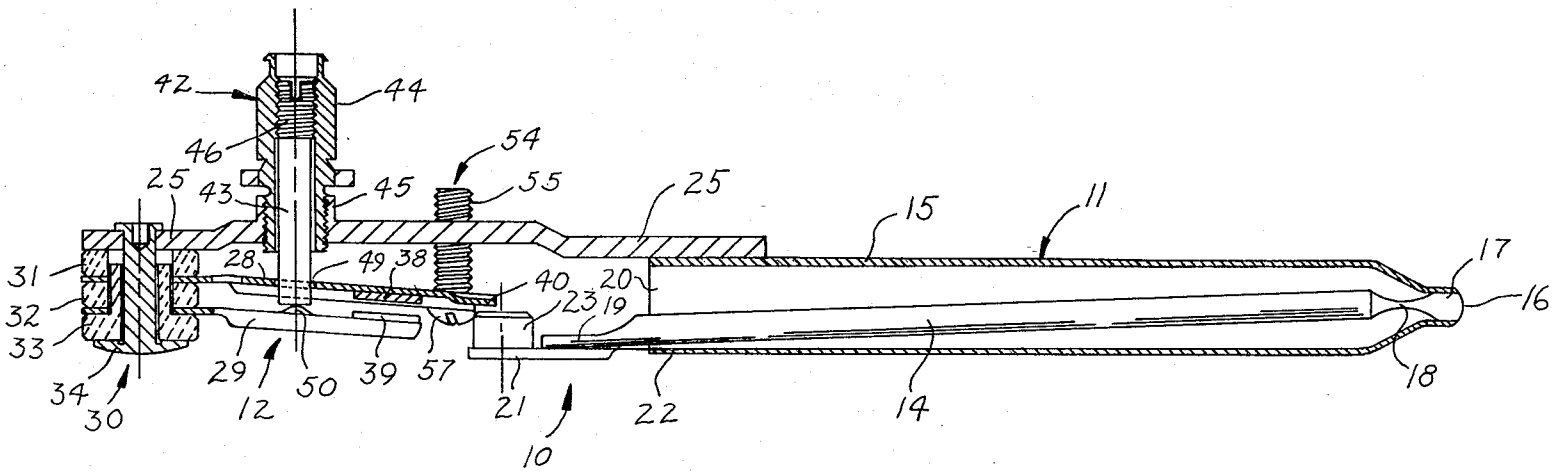
FIG. 2 is a side sectional view of the thermostat of FIG. 1.

The rod 14 is formed of a material having one thermal coefficient of expansion, while the tubular body 15 is formed of another material having a different coefficient of expansion. In the illustrated probe thermostat 10, the rod 14 is formed of a material having a lower coefficient of expansion, and the tubular body 15 is formed of a metallic material having a higher coefficient of expansion. Thus, when the probe thermostat is subjected to heat, the tubular body 15 expands to a greater extent than the rod 14, so that the rod end 19 is pulled away from the adjacent portion of the open end 20 of the tubular body 15 and the projecting member 21 moves laterally (upwardly as shown in FIG. 2). The rod 14 pivots about its hinged portion 18, while the end 17 remains securely attached to the head 16 of the tubular body. The relative movement of the projecting member 21 thus corresponds to the change in temperature to which the thermal sensing portion 11 is subjected.

The lateral motion of the projecting portion 21 is used to operate the switch portion 12 of the thermostat. The switch portion 12 is mounted on a base plate 25. One end of the base plate 25 is formed into a curved collar portion 26 (FIG. 1), with the open end 20 of the tubular body 15 mounted within the collar portion 26. At the other end of the base plate 25, a pair of contact arms 28 and 29 are mounted in a stack 30 (FIG. 2). The contact arms 28 and 29 are formed of strips of electrically conductive material such as copper, and extend generally parallel to each other and generally parallel to and beneath the base plate 25 (as shown in FIG. 2). The stack 30 comprises a pair of insulative annular washers 31 and 32 and an insulative cylindrical washer sleeve 33 secured together by a rivet or pin 34. The first contact arm 28 is mounted between the washers 31 and 32, and the second contact arm is mounted between the washer 32 and the washer sleeve 33. Each of the contact arms 28 and 29 is insulated from the rivet 34 and the base plate 25 by the sleeve portion of the washer sleeve 33. Each of the contact arms 28 and 29 includes a projecting terminal or junction 36 (FIG. 1) which extends outwardly from one of the sides of the stack 30 and may be used for connection of the contact arm to appropriate circuit means.

At the end of each of the contact arms opposite its attachment in the stack 30, each of the arms 28 and 29 has a contact 38 and 39. The contact 38 is located on the bottom surface of the first or upper contact arm 28, as shown in FIG. 2, and extends downwardly toward the contact 39 on the second or lower contact arm 29. The contact 39 is located on the upper surface of the lower contact arm 29. Each of the contact arms 28 and 29 is formed of a resilient conductive material and each contact arm is bent or biased adjacent to its attachment at the stack 30 so that the contacts 38 and 39 are spring-biased or urged into contact with each other when each of the contact arms 28 or 29 is free to move.

The contact 39 is located near the free extending end of the arm 29, but the arm 28 includes a portion 40 which extends beyond the contact 38. The extending portion 40 is capable of being engaged by the bumper 23 on the projecting member 21 of the thermal sensing portion of the thermostat.

Movement of the contact arms is provided by a variable control means 42 which is secured in an opening in the base plate 25. The control means 42 has elongated cylindrical finger 43 disposed within a rotatable outer sleeve 44. The finger 43 is formed of an electrically insulative material and is capable of moving longitudinally within the rotatable sleeve 44. The sleeve 44 is mounted for rotation in a collar 45 formed around the opening in the base plate 25. The inside of the sleeve 44 is threaded, and the upper portion 46 of the finger 43 is correspondingly threaded to engage the inside of the sleeve 44, so that rotation of the sleeve 44 results in movement of the finger 43 longitudinally (up and down as shown in FIG. 2). If desired, the sleeve 44 may include a projecting portion 47 (FIG. 1) which engages a fixed stop 48 extending from the base plate 25 to prevent rotation of the sleeve 44 beyond a certain limit. In normal installations of the probe thermostat 10, a larger control knob is placed around the sleeve 44 to facilitate rotation of the sleeve and to permit control and operation of the thermostat, and the outer portion of the sleeve 44 is provided with longitudinally extending knurls (FIG. 1) around its outside for engagement with the knob.

The finger 43 extends through an opening 49 in the first contact arm 28 and engages the second contact arm 29 between the stack 30 and the contact 39. A projection 50 may be provided on the second contact arm 29 for engagement with the finger 43. Rotation of the sleeve 44 results in the finger 43 moving the second contact arm 29 laterally (up and down as shown in FIG. 2) due to the spring-biasing by which the first and second contact arms 28 and 29 are urged toward contact with each other. While the switch is closed, the first contact arm 28 also moves laterally with the second contact arm 29, and the contacts 38 and 39 remain in contact with each other. When the second contact arm 29 is moved laterally (downwardly) by the finger 43 of the control means 42 a sufficient amount, the extending end 40 of the first contact arm 29 engages the bumper 23 on the projecting member 21 of the thermal sensing portion of the thermostat. Further lateral (downward) movement of the second contact arm 29 results by the control means 42 in the contacts 38 and 39 moving apart so that the switch is open. When the control means 42 is reversed and the finger 43 moves in the opposite direction (upwardly), the second contact arm 29 also moves laterally (upwardly) and the contacts 38 and 39 again come together and the switch is closed.

In operation of the probe thermostat 10, the control means 42 is turned and set in a desired precalibrated position so that the second contact arm 29 is laterally disposed in a position which represents a desired thermal condition. Due to the spring-biased arrangement of the first and second contact arms 28 and 29, the contacts 38 and 39 are urged together so that the switch is closed. Electrical current flows through both contact arms 28 and 29, and this current may be used as desired, such as to provide heating to the area which the thermostat controls. As the area is heated, the thermal sensing portion 11 of the thermostat responds to the increased heating, and due to the expansion differential of the elements of the thermal sensing portion, the projecting member 21 moves laterally (upwardly as shown in FIG. 2). When the projecting portion 21 has moved laterally a sufficient amount, the bumper 23 on the end of the projecting portion 21 will engage the extending end 40 of the first contact member 28, lifting the first contact member 28 as shown in FIG. 2. As the projecting member 21 moves or lifts the first contact arm 28, it moves the contact 38 away from the contact 39 so that the switch is opened. The open switch may be used to stop the heating of the area which the thermostat controls. As the area cools, the projecting member 21 will move laterally in the opposite direction (downwardly as shown in FIG. 2) and eventually the first contact arm 28 will move back toward the second contact arm 29 and the contacts 38 and 39 will come into contact with each other again to close the switch. The temperature at which the switch is opened and closed can be varied by the variable control means 42. The lateral position of the second contact arm 29 as set by the finger 43 determines the temperature at which the switch will be opened or closed.

In accordance with the present invention, a positive-off element 54 is provided. In the illustrated form of the invention, the positive-off element 54 comprises a threaded fastener 55, such as a screw or bolt, which extends adjacent to the side of the contact arms 28 and 29. The threaded fastener 55 is mounted in an extension 56 (FIG. 1) formed on one side of the base plate 25. The positive-off element 54 should be formed of an insulative material to prevent conduction between the first contact arm 28 and the base plate 25. The fastener 55 has head 57 and is positioned so that the shoulder formed by the head 57 engages the edge of the first contact arm 28 and prevents further movement of the extending portion 40 of the first contact arm (downwardly as shown in FIG. 2). The control means 42 is moved to its "off" position with the finger 43 fully extended. In such position, the second contact arm 29 is moved (downwardly as shown in FIG. 2) to a position in which the contacts are open because the head 57 of the positive-off element 54 engages the edge of the first contact arm 28, holds the first contact arm, and prevents further movement of the first contact arm in the direction of the second contact arm 39. Thus, the positive-off element 54 assures that the contact arms 28 and 29 will be separated and the switch will be opened, regardless of the position of the bumper 23.

The positive-off element 54 is installed in the thermostat by placing the thermostat in an environmental condition in which the projecting member 21 would be at a reasonable "cool" position furthest from the base plate 25, and the variable control means 42 is moved to its "off" position in which the finger 43 is fully extended and the switch should remain open at all times. The fastener 55 comprising the positive-off element 54 is then threaded into the opening in the extension 56 on the base plate 25, and is adjusted longitudinally (up and down as shown in FIG. 2) until the head 57 is ositioned so that it will engage the first contact arm 28 and maintain the contacts open without interfering with operation of the thermostat. After the fastener 55 has been properly positioned, a sealing compound or some other securing means is placed over the fastener 55 to prevent any further movement of the fastener which might interfere with proper operation of the switch or which might inhibit the positive-off function of the element.

Various modifications to the illustrated form of the invention are possible. For example, instead of providing an extension 56 as part of the base plate 25, a separate projecting portion could be attached to the base plate 28 such as by welding. The separate projecting portion could be a thin sheet metal fastener with an opening having a self-locking type thread in which the fastener 55 is mounted. By using a self-locking type thread, the need for placing sealing compound over the fastener 55 after final positioning or calibration of the fastener is eliminated. As another possible modification, the sheet metal fastener, which is used instead of the extension 56, could be the type which would snap onto the base plate 25. As a further modification, the projecting portion or the extension 56 on the base plate could be appropriately insulated from the base plate 25 so that a metal fastener or other element could be used. Additionally or alternatively, the fastener 55 could be provided with a self-locking type thread to secure it in place.

Although a preferred embodiment of this invention is illustrated, it should be understood that various modifications and rearrangement of parts may be resorted to without departing from the scope of the invention disclosed and claimed herein.

What is claimed is:

1. An improved thermostat of the type having a base;

a switch on said base including a first contact arm attached at one end to the base and a second contact arm attached at one end to the base, the first and second contact arms being spring-biased with a contact portion of each contact arm being resiliently urged toward engagement with a contact portion of the other arm, engagement of said contact portions closing said switch;

a variable control means which engages the second contact arm and moves the second contact arm laterally against its spring bias to a position corresponding to a desired thermal condition; and a temperature-responsive assembly mounted to the base and including a projecting member which moves in response to the changes in thermal conditions, the projecting member engaging the first contact arm to move it against its spring bias out of contact with the second contact arm in response to a thermal condition exceeding the desired condition set by the variable control means;

wherein the improvement comprises positive-off means on the base and having a portion which engages the first contact arm when the variable control means is set in an extreme position to hold the first contact arm away from the second contact arm.

2. An improved thermostat as defined in claim 1, wherein the positive-off means comprises a separate element mounted on said base and having a surface which engages the first contact arm to limit its movement in a direction toward said second contact arm beyond a predetermined position.

3. An improved thermostat as defined in claim 2, wherein the separate element is adjustably mounted on said base with the position of said stop surface capable of adjustment, and said separate element is locked against movement relative to the base after adjustment.

4. An improved thermostat as defined in claim 3, wherein the said separate element is a threaded fastener and is locked with respect to the base after adjustment by placing sealing compound over the fastener.

5. An improved thermostat as defined in claim 2, wherein said separate element is made of an electrically insulative material.

6. An improved probe thermostat of the type having:

a base;

a first contact arm insulatively attached at one end to the base with the other end free to move laterally, the free end of the first contact arm being spring-biased and urged to move away from the base, the free end of the first contact arm having a contact portion disposed on the side thereof away from the base;

a second contact arm insulatively attached at one end to the base with the other end free to move laterally, the free end of the second contact arm being spring-biased and urged to move toward the base and toward the first contact arm, the free end of the second contact arm having a contact disposed on the side thereof closest to the first contact arm, the first and second contact arms extending generally parallel to each other from their attachment ends, the spring-biasing of the free ends of the first and second contact members urging the contacts into engagement with each other;

a variable control means mounted on the base and having a portion which engages the second contact member and moves the free end of the second contact member laterally against its spring bias to a lateral position corresponding to a desired thermal condition; and a differential expansion assembly mounted to the base and including a projecting member which moves laterally in response to changes in thermal conditions, the projecting member engaging the free end of the first contact arm to move the contact on the first contact arm out of engagement with the contact on the second arm in response to a thermal condition exceeding the desired condition set by the variable control means;

wherein the improvement comprises a positive-off element mounted on the base and having a shoulder portion which engages the free end of the first contact arm when the second contact arm has been moved by the variable control means away from the first contact arm to an extreme position to hold the contact on the first arm away from the contact on the second arm.

7. An improved probe thermostat as defined in claim 6, wherein the positive-off element comprises a fastener mounted to the base and having a head wich engages the free end of the first contact arm.

8. An improved probe thermostat as defined in claim 7, wherein the fastener is adjustably mounted to the base with the position of the head capable of adjustment, and the fastener is secured to the base after adjustment.

9. An improved probe thermostat as defined in claim 6, wherein the fastener is secured to the base with sealing compound being placed over the fastener.

10. An improved probe thermostat as defined in claim 8, wherein the fastener is made of an electrically insulative material.

11. An improved probe thermostat as defined in claim 6, wherein the positive-off element is mounted to a portion projecting from the base.

12. A positive-off thermostat comprising a base, a switch mounted on said base providing first and second contact support arms, each cantilever mounted at one end on said base and providing a contact portion spaced from said one end, said support arms being resiliently biased toward each other to cause said contact portions to close said switch and each being movable against said bias in a direction away from the other contact support arm to separate said contact portions and open said switch, temperature-responsive means engageable with said first arm operable to move it in a direction away from said second arm to positions determined by the temperature of said temperature-responsive means, stop means on said base engageable with said first arm operable to limit movement thereof toward said second arm beyond a predetermined position, and temperature adjusting means engageable with said second support arm operable to adjustably limit the movement of said second support arm in a direction toward said first support arm beyond positions determined by the adjustment thereof, said temperature adjusting means being adjustable through a temperature range in which said switch is closed when said temperature-responsive means senses predetermined temperatures and also being adjustable to a positive-off position in which said contact portions are spaced from each other when said first support arm engages said stop means whereby said contact portions cannot close in response to operation of said temperature-responsive means.

* * * * *